United States Patent [19]

Sticht et al.

[11] Patent Number: 4,523,447

[45] Date of Patent: Jun. 18, 1985

[54] WIRE COILER

[75] Inventors: Walter Sticht; Gerhard Schwankhart, both of Attnang, Austria

[73] Assignee: Stiwa-Fertigungstechnik Sticht Gesellschaft m.b.H., Attnang, Austria

[21] Appl. No.: 531,902

[22] Filed: Sep. 13, 1983

[30] Foreign Application Priority Data

Sep. 30, 1982 [AT] Austria ..... 3614/82

[51] Int. Cl.[3] ..... B21F 3/04

[52] U.S. Cl. ..... 72/144

[58] Field of Search ..... 72/135, 138, 139, 142, 72/143, 144, 145, 183; 242/207

[56] References Cited

U.S. PATENT DOCUMENTS

| | | | |
|---|---|---|---|
| 716,555 | 12/1902 | King | 72/144 X |
| 915,673 | 3/1909 | Heid | 72/144 X |
| 1,504,849 | 8/1924 | Whitmore et al. | 72/144 X |
| 2,165,411 | 7/1939 | Peyton | 72/142 |
| 2,592,590 | 4/1952 | Oberg | 72/143 |
| 2,649,130 | 8/1953 | Border | 72/144 |
| 2,758,629 | 8/1956 | Lewis | 72/142 X |
| 4,130,003 | 12/1978 | Campbell | 72/142 X |

FOREIGN PATENT DOCUMENTS

| | | | |
|---|---|---|---|
| 1639283 | 2/1970 | Fed. Rep. of Germany . | |
| 515368 | 12/1939 | United Kingdom | 242/207 |

*Primary Examiner*—E. Michael Combs
*Attorney, Agent, or Firm*—Kurt Kelman

[57] ABSTRACT

A wire coiler comprising an elongated coil support, gripping device holding the coil support for rotation therewith, a drive connected to the gripping device for rotating the gripping device, the drive having an axis extending parallel to the direction of elongation of the coil support, a control for the drive, a device for guiding and feeding the wire to the coil support, and an adjustment drive connected and responsive to the rotating drive control, the adjustment drive cooperating with the wire guiding and feeding device for adjustably positioning the same in directions parallel to the direction of elongation of the coil support and relative thereto.

20 Claims, 9 Drawing Figures

106
107
108
109
110
111
112
113
114
115
116
117
118
16
17
3
(52)
38
(62)

WIRE COILER

The present invention relates to a wire coiler comprising an elongated coil support, a gripping device holding the coil support for rotation therewith and a device for guiding and feeding the wire to the coil support.

German Pat. No. 1,914,946 discloses a wire coiler wherein mandrels for producing wire coils are mounted on a turntable. The drive shaft is permanently coupled to a drive and is displaceable relative to the turntable for operatively connecting the drive shaft to a respective mandrel. Two cooperating wire clamping jaws, which are movable relative to each other in an axial direction, are associated with the drive shaft at an end thereof facing the mandrel. When the displacement device for the drive shaft is actuated, the wire is gripped by the clamping jaws. The mandrels are axially displaceably arranged on the turntable for producing the desired wire coils. The manufacture of this apparatus is very expensive since the drive shaft must be displaced in its axial direction to couple it to the mandrel coil support. In addition, the mandrel is displaced in its axial direction and rotated about its axis, all of which requires complex controls.

It is the primary object of this invention to provide a wire coiler of the first-described type which is capable of successively handling wires of different gages and which is readily controllable to change the pitch and the number of windings of each coil within wide ranges.

It is another object of the invention to provide a wire coiler for coiling wire on a support of rectangular cross section and for handling wires of polygonal cross section.

The above and other objects are accomplished according to one aspect of the present invention with a wire coiler comprising a drive connected to the gripping device for rotating the gripping device, the drive having an axis extending parallel to the direction of elongation of the coil support, and a control for the drive. An adjustment drive is connected and responsive to the rotating drive control, the adjustment drive cooperating with the wire guiding and feeding device for adjustably positioning the same in directions parallel to the direction of elongation of the coil support and relative thereto.

This arrangement has the unexpected advantage of enabling the wire coiler to be universally adapted to various coiling conditions. The pitch of the coil may be steplessly changed within wide ranges without influence on the rotating drive because the rotation of the oil support and the vertical guidance of the wire to be coiled are separately controlled. This also makes it possible to effectuate separate positioning movements of the wire on the support when wires of polygonal cross section are wound and/or supports of polygonal cross section are used. Furthermore, the separate arrangement for producing the coil pitch makes it possible to adapt the wire coiler rapidly to different types of wires. In addition, the accessability and maintenance of the machine are also improved and simplified.

According to another aspect of this invention, there is provided a method of coiling a wire on a wire coiler comprising an elongated coil support, a gripping device holding the coil support for rotation therewith, the gripping device comprising two gripping elements spaced from each other in the direction of elongation of the coil support and one of the gripping elements having two cooperating gripping jaws, the one gripping element comprising a sliding element for positioning the coil support in relation to one of the gripping jaws, a drive common to the two gripping elements and connected to the gripping device for rotating the gripping device, the drive having an axis extending parallel to the direction of elongation of the coil support, a control for the drive, a device for guiding and feeding the wire to the coil support, the wire guiding and feeding device having two relatively adjustable guide jaws, a clamping drive for adjusting the guide jaws relative to each other and for clamping the guide jaws in their adjusted position, and a guide arm associated with one of the gripping elements, the guide arm being pivotal about an axis extending parallel to the coil support, a carrier slide supporting the wire guiding and feeding device, a guide track adjustably supporting the carrier slide, the guide track extending in the direction of the wire being guided and fed by the device, a drive connected to the carrier slide for advancing the carrier slide along the guide track, and an adjustment drive connected and responsive to the rotating drive control, the adjustment drive cooperating with the wire guiding and feeding device for adjustably positioning the same in directions parallel to the direction of elongation of the coil support and relative thereto, which method comprises the steps of operating the clamping drive for clamping the wire between the clamping jaws of the wire guiding and feeding device while fixing the pivotal guide arm in a rest position, subsequently operating the drive for advancing the carrier slide along the guide track in the direction of the one gripping element while operating the drive for positioning the coil support into engagement with one of the gripping jaws of the one gripping element, engaging the gripping jaws with each other after the wire has been fed to the one gripping element, and then operating the adjustment drive for moving the wire guiding and feeding device in the direction of elongation of the coil support from the one gripping element towards the other gripping element.

This wire coiling method has the advantage that no countersupport for positioning the coil on the elongated support is needed and the wire may be gripped with the support by the gripping device since the wire is disengaged from the gripping device when the wire guiding and feeding device is vertically adjusted. This makes it possible to engage the elongated coil support at the very beginning of the coil and to reduce or possibly entirely eliminate any deformation of the coil support by the tension forces exerted thereupon during coiling.

The above and other objects, advantages and features of the invention will become more apparent from the following detailed description of certain now preferred embodiments thereof, taken in conjunction with the accompanying, partly schematic drawings wherein FIG. 1 is a perspective view of one embodiment of a wire coiler according to the present invention;

Figures 1, 2, 3, 4:
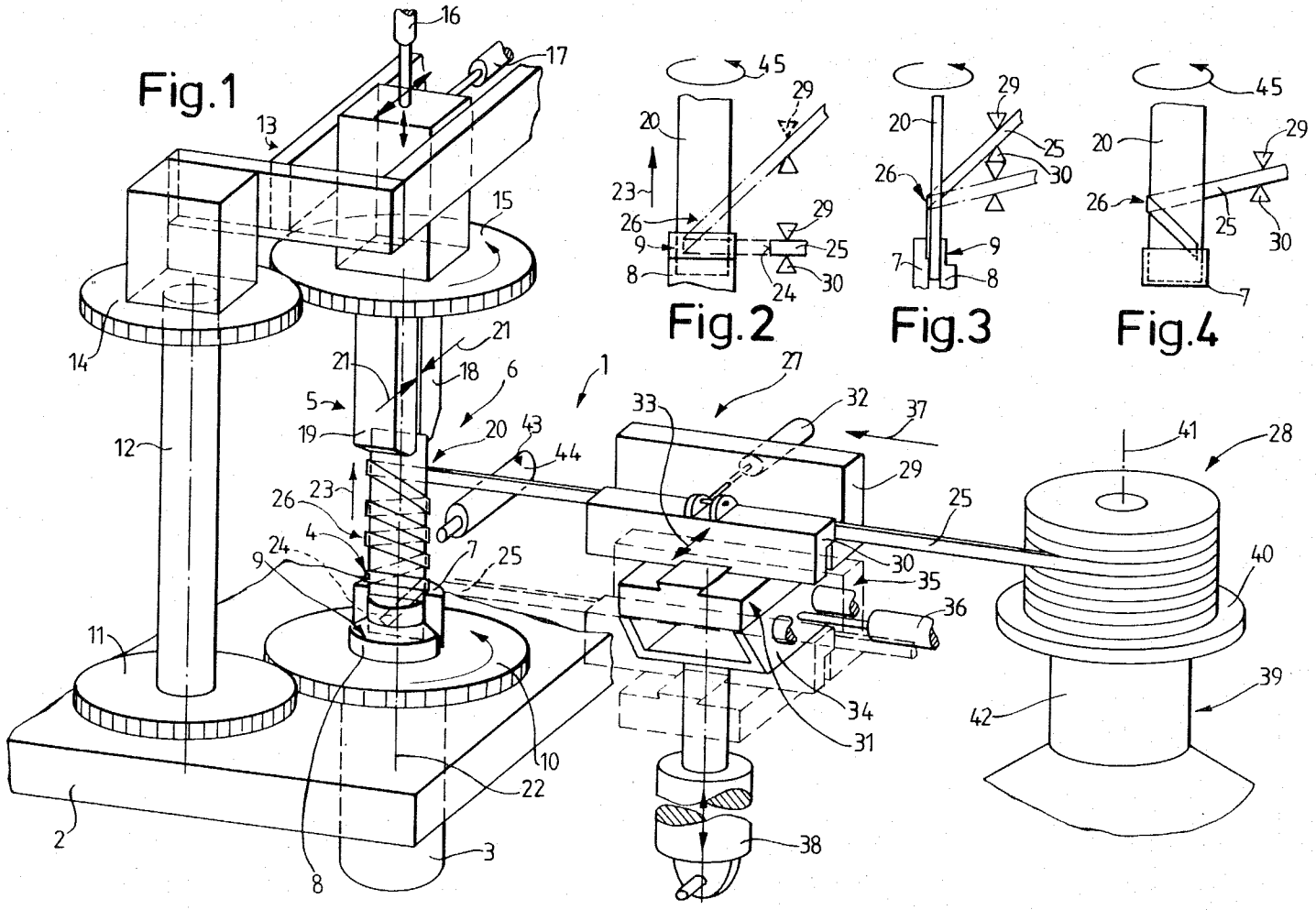
FIG. 2 is a side elevational fragmentary view of the elongated coil support of the wire coiler of FIG. 1, carrying one winding of the coil.
FIG. 3 shows the support after a 90° turn.
FIG. 4 illustrates yet another position of the support with a part of a coil carried thereon.
Figure 9:
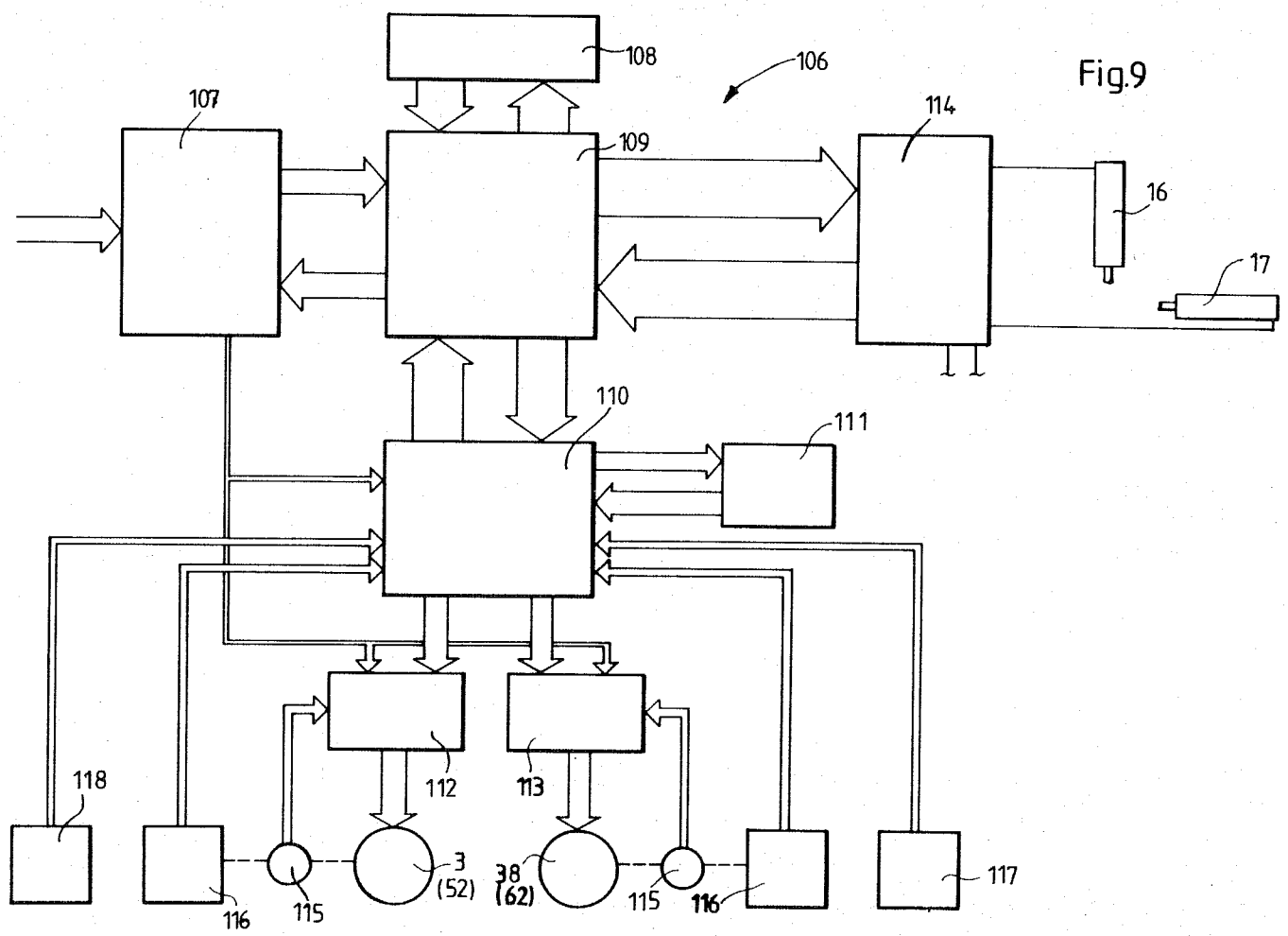
FIG. 9 is a circuit diagram of a control for the wire coiler of the present invention.

Referring now to the drawing and first to FIG. 1, there is shown wire coiler 1 comprising elongated coil support 20, gripping device 6 holding the coil support for rotation therewith and drive 3 connected to the gripping device for rotating the gripping device, the drive having axis 22 extending parallel to the direction of elongation of coil support 20 indicated by arrow 23. Control 106 for the drive is shown in FIG. 9 and will be fully explained hereinafter in connection with the description thereof. Device 27 guides and feeds wire 25 to coil support 20. Adjustment drive 38 is connected and responsive to the rotating drive control and cooperates with the wire guiding and feeding device for adjustably positioning the same in directions parallel to direction of elongation 23 of coil support 20 and relative thereto.

In the illustrated embodiment, gripping device 6 comprises two gripping elements 4 and 5 spaced from each other in direction of elongation 23 of coil support 20, rotating drive 3 being common to the two gripping elements. Gripping element 5 is mounted in holder 13 for adjustably positioning the gripping element in relation to gripping element 4 in direction 23 by adjustment drive 16 and for adjustably positioning gripping element 5 in relation to gripping element 4 transversely to this direction by adjustment drive 17. These adjustment drives may be manually operated. The use of two separate gripping elements enables the gripping of the elongated coil support to be rapidly adjusted to different support lengths. Furthermore, one gripping element may be used to hold the support while the wire is engaged with the other gripping element together with the support at the beginning of the coiling operation. Also, the one gripping element may be part of, or associated with, a manually operated device so that the coil supports may be removed from carriers passing by the wire coiler and may be positioned in the wire coiler by this gripping element.

As shown in FIG. 1, gripping element 5 has two cooperating gripping jaws 18, 19 adjustable in relation to each other in the direction of arrows 21 for engaging and releasing elongated coil support 20. Gripping element 4 also has cooperating gripping jaws 7, 8 adjustable in relation to each other in the same direction. Machine table 2 supports wire coiler 1 and gripping element 4 is mounted the machine table. Element 43 comprising cylinder-and-piston drive 44 is arranged for slidingly moving support 20 relative to gripping element 4 and, as will be explained more fully hereinbelow, this gripping element is arranged for gripping the coil support and one end of wire 25 to be coiled thereon simultaneously to form winding 26. This arrangement facilitates threading the leading wire end into coiler at the beginning of the coiling operation and simultaneously engaging the wire end and the coil support in the one gripping element.

As shown in FIG. 1, rotating drive 3 is connected to gripping element 4 for rotation therewith and a respective gear 10 and 15 is associated with each gripping element 4 and 5. Intermediate drive shaft 12 has respective gears 11 and 14 meshing with gears 10 and 15 of gripping elements 4 and 5 in a coiling position of gripping device 6, gears 10 and 11 being supported on machine table 2 while gears 14 and 15 are supported on holder 13 which, in turn, is supported on the machine table. Meshing gears 10, 11 of gripping element 4 and intermediate drive shaft 12 cause rotating drive 3 to rotate the intermediate shaft. This arrangement combines the advantages of a fixedly journaled rotating drive with those provided by one of the gripping elements serving as a device for delivering the coil support to the coiler. Since gear 15 for other gripping element 5 is adjustably but fixably supported in holder 13, it is possible to use a gear train which may be subjected to considerable torque while constituting a very exact force transmission. After each movement of the other gripping element, it can be readily and accurately repositioned in relation to fixed gripping element 4 so that the two gripping elements rotate in unison. This assures high accuracy in the coiling and the coil support is never subjected to torque because the two gripping elements are not in proper alignment.

Device 27 for guiding and feeding wire 25 to coil support 20 for producing winding 26 has two relatively adjustable guide jaws 29, 30 and clamping drive 32 adjusts the guide jaws relative to each other and clamps the guide jaws in their adjusted position. The guide jaws serve also for positioning the leading end of wire 25 relative to coil support 20 before the coiling operation begins. As shown in FIG. 1, guide jaw 30 is slidably mounted on guide 31 and the clamping drive is linked to this guide jaw to adjust it in relation to guide jaw 29 in the direction of double-headed arrow 33. The clamping drive may be operated to adjust the spacing between the two guide jaws so that they may clamp and hold wire 25 therebetween or may permit the wire to be guided therebetween on the way to the coil support. This spacing may be adjusted for different wire gages. Furthermore, guide 31 for guide jaws 29, 30 of wire guiding and feeding device 27 is supported on carrier slide 34 and guide track 35 adjustably supports the carrier slide, the guide track extending in the direction of the wire being guided and fed by device 27. Drive 36 is connected to carrier slide 34 for advancing the carrier slide along guide track 35 in the direction of arrow 37. Adjustment drive 38 is mounted on carrier slide 34 to enable guide 31 with guide jaws 29, 30 to be adjusted in the direction of arrow 23 relative to coil support 20. This arrangement enables wire guiding and feeding device 27 to be used also to advance wire 25 at the end of a coiling operation to position the leading end of the wire for the subsequent coiling operation and for threading this leading wire end in the gripping device. In this manner, no auxiliary devices are needed for positioning the aligned wire again for the subsequent coiling operation.

Illustrated wire coiler 1 further comprises storage device 28 for wire 25. The storage device is arranged to unreel the stored wire and to feed the unreeled wire to wire guiding and feeding device 27. Automatic braking device 39 for wire storage device 28 is connected to drive control 106 for actuating the braking device in response to the weight of the wire storage device. This comprises horizontally extending wire support plate 40. Rotatable axle 41 supports the support plate and friction coupling 42 is arranged between axle 41 and support plate 40 to form the braking device. Support plate 40, on which reeled wire 25 rests, is freely movable in the direction of axle 41 so that the changing weight of the wire on the plate will exert a changing pressure on friction coupling 42 as the wire is unreeled. The resistance to the unreeling of the wire is, therefore, automatically adjusted as a function of the wire weight on support plate 40. The friction coupling brake enables the wire to be unreeled at a constant speed and deformation of the wire during the coiling operation or during short pauses for positioning the wire during the coiling operation are avoided. This relieves any undue tensions on the wire material and also avoids undesired bends therein. This enhances the dependable functioning of the wire coiler. If the braking power is a direct function of the weight of the wire stored on device 28, undue tensioning of the wire is avoided, particularly if a relatively short length of wire is left.

When wire 25 is threaded into gripping element 4, drive 43 is operated to press coil support 20 against gripping jaw 8 so that there is sufficient space between the coil support and cooperating gripping jaw 7 to permit the wire to be introduced therebetween.

FIGS. 2 to 4 illustrate the manner of producing winding 26 on coil support 20. An elongated conveyor system may, for example, move a succession of carriers for coil supports 20 past wire coiler 1 and gripping element 5 may be operated by vertical and transverse drives 16 and 17 to remove a respective coil support from its carrier and to center it between gripping jaws 7 and 8 of gripping device 4. Drive 43 is then operated to press the coil support held by gripping device 5 against gripping jaw 8 of gripping device 4. Clamping drive 32 is then operated to clamp wire 25 between guide jaws 29 and 30 of wire guiding and feeding device 27, as shown in FIG. 2. Leading end 24 of wire 25 is moved forwardly from the position shown in full lines by operating drive 36 to advance carrier slide 34 so that the leading wire end is in registry with coil support 20. Gripping jaws 7, 8 are now closed so that they clamp coil support 20 and leading wire end 24 therebetween. At this point, wire 25 is in the position shown in broken lines in FIG. 2. Adjustment drive 38 is now operated to lift wire guiding and feeding device 27 in the direction of arrow 23 so that wire 25 assumes the position shown in chain-dotted lines in FIG. 2. During this vertical stroke, wire 25 remains clamped between guide jaws 29, 30 to enable this winding to be properly made. Once this first winding has been made, wire guiding and feeding device 27 may be released in relation to gripping element 4. To enable the pitch of the first winding to be held to a small dimension, if desired, i.e. to execute a small vertical stroke of device 27, gripping jaw 8 of gripping element 4 defines recess 9 arranged on a side of coil support 20 opposite the coil support side receiving the wire from the guiding and feeding device. Recess 9 is positioned in the range of the gripping jaw facing the wire guiding and feeding device in an initial position at the beginning of the coiling operation. In this manner, wire guiding and feeding device 27 and gripping element 4 will not interfere with each other during the subsequent rotation of coil support 20. After the first winding has been completed, guide jaws 29, 30 are moved slightly apart, as indicated by the position of guide jaw 29 shown in broken lines in FIG. 2, thus permitting wire 25 to be fed to the coil support as it is turned 90° by rotating drive 3 in the direction of arrow 45.

FIG. 3 illustrates the position of coil support 20 after it has been turned 90°. Subsequent to this turn, wire 25 is clamped between guide jaws 29, 30, as shown in full lines, and is bent downwards into the position shown in chain-dotted lines by executing a downward vertical stroke of wire guiding and feeding device 27. This enables the pitch of subsequent windings 26 to be reduced. After the wire has been bent down to reduce the pitch, guide jaws 29, 30 are again sufficiently moved apart to enable the wire to be fed therebetween. FIG. 3 shows a recess in a side of gripping jaw 7 facing support 20 to enable wire 25 to be received between the gripping jaw and the support. Recess 9 in gripping jaw 8 is also clearly shown in FIG. 3.

FIG. 4 shows the position of coil support 20 after a further 90° turn in the direction of arrow 45. During this rotation of the coil support, the wire passes freely between guide jaws 29, 30, the pitch of the winding being smaller than that of the first winding. The remaining windings are then produced with the same pitch in a like manner until wire 25 has formed the coil shown in full lines in FIG. 1 at the end of the coiling operation. After all windings 26 of the coil have been finished, the wire may be cut at some point between coil support 20 and wire guiding and feeding device 27, gripping jaws 8, 9 of gripping element 4 may be moved apart and the finished wire coil on support 20 may be moved back by gripping element 5 to one of the carriers on the conveyor passing by wire coiler 1, for example, or it may be moved to any suitable discharge station.

Figures 5, 7, 8:
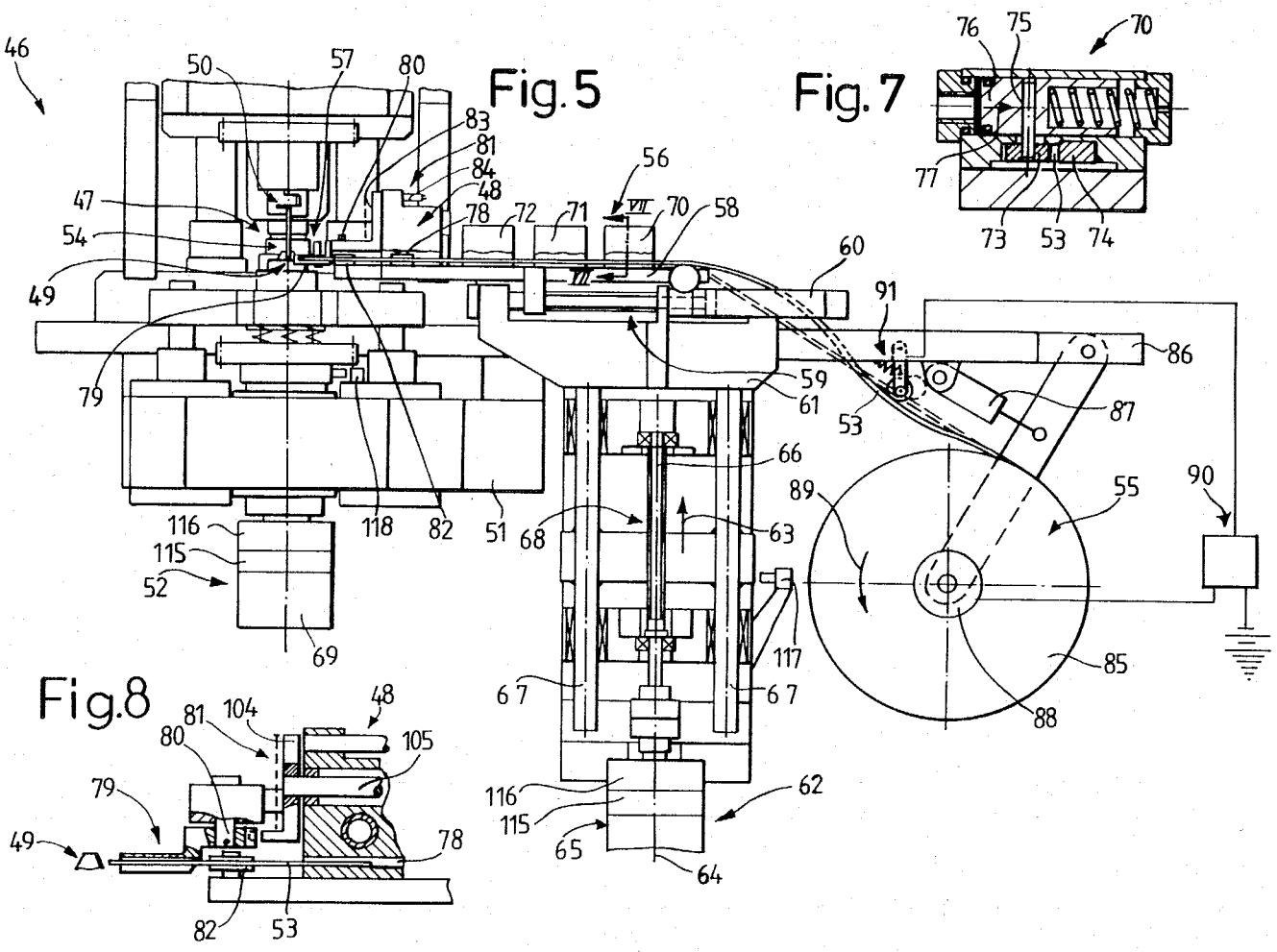
FIG. 5 is a side elevational view of another embodiment of the wire coiler of this invention.
FIG. 7 is an end view section along line VII—VII of FIG. 5 of an alignment station of the wire coiler.
FIG. 8 is an enlarged side view, partly in section, of the guide arm of the wire guiding and feeding device of the wire coiler of the invention.

FIGS. 5 to 8 illustrate wire coiler 46 comprising gripping device 47 and wire guiding and feeding device 48. As in the above-described embodiment, gripping device 47 comprises gripping elements 49, 50 and gripping element 49 is mounted on machine table 51 which also carries rotating drive 52 for the gripping device. Wire 53 is unreeled from storage device 55 to be fed through wire aligning device 56 to wire guiding and feeding device 48 which guides and feeds the wire to coil support 54, as has been described hereinabove. Wire cutting device 57 is arranged between device 48 and support 54. As shown in FIG. 5, carrier slide 58 supports wire guiding device 48, wire aligning device 56 arranged between wire storage device 55 and device 48 as well as wire cutting device 57 arranged between devices 48 and 47 for determining the length of the coiled wire. Guide track 59 adjustably supports carrier slide 58, the guide track extending in the direction of wire 53 being guided and fed by device 48, and drive 60 is connected to the carrier slide along the guide track. Guide track 59 is supported on carrier frame 61 which is movable by adjustment drive 62 in a direction parallel to axis 64 of rotating drive 52, as indicated by arrow 63. Adjustment drive 62 comprises servo-motor 65 coupled to threaded spindle 66. Motor 65 may be, for example, a direct-current servo-motor with tachoalternator control. Two guide columns 67 support carrier frame 61 for rectilinear vertical movement and nut arrangement 68 on the carrier frame meshes with threaded spindle 66 to move the carrier frame up and down upon rotation of the spindle by the servo-motor. Rotating drive 52 comprises servo-motor 69. Using servo-motors for the rotation of coil support 54 as well as the vertical wire movement on the support in the direction of arrow 63 enables a programmed control, which will be explained hereinafter in connection with FIG. 9, to adapt the wire coiler universally to the production of coils of different pitches as well as different numbers of windings.

The arrangement of a wire aligning device between the storage device and the guiding and feeding device enables any significant deformations in the wire to be straightened out so that the wire coiler may be used not only with thin, flexible wires but also with stiff wires, such as wires of a rectangular or other polygonal cross section. The provision of a wire cutting device, such as two cooperating knives adjustable in relation to each other, enables the wire to be cut after it has been properly aligned.

As shown in FIG. 5, wire aligning device 56 comprises a succession of rectilinearly arranged aligning stations 70, 71, 72 mounted on carriage slide 58. The structure of the aligning stations is illustrated in FIG. 7 in connection with station 70. As shown, the aligning station comprises a pair of relatively adjustable lining jaws 73, 74 receiving wire therebetween. A drive is provided to adjust the lining jaws relative to each other, for which purpose lining jaw 73 is connected by entrainment element 75 with piston 76 which is reciprocable against the bias of a coil spring transversely to wire 53 in the direction of arrow 77. For the rectilinear alignment of wire 53, pressure fluid is supplied to the lining jaw drives of successive aligning stations 70, 71, 72 to clamp the wire between the lining jaws and thus to align the wire in the direction of its elongation. With heavy-gage wires, the aligning stations may be additionally operated as braking stations to delay the feeding of the wire uniformly during intermittent stops the feeding of the wire.

As more clearly shown in FIG. 8, wire guiding and feeding device 48 comprises not only two cooperating guide jaws of which guide jaw 78 is illustrated but also guide arm 79 associated with gripping element 49. The guide arm is pivotal about axis 80 extending parallel to coil support 54 and wire guide roller 82 is arranged between the guide jaws and the wire guide arm in the range of axis 80 to assure a rectilinear guidance for wire 53 when guide arm 79 is pivoted. Fixing device 81 enables pivotal guide arm 79 to be fixed in a position in alignment with the longitudinal extension of wire 53. Fixing device 81 comprises fixing arm 83 with an abutment 104 which may be adjusted by drive 84 shown as rod 105 in the direction of guide arm 79 (see position indicated in broken lines) so that the guide arm is aligned with wire 53, the abutment engaging a recess in guide arm 79 to hold the same against rotation about pivoting axis 80. This fixed position is required to enable the leading end of the wire to be threaded accurately between the gripping jaws of gripping element 49 at the beginning of the coiling operation when carrier slide 58 is advanced towards the coil support in the manner described hereinabove in connection with the embodiment of FIG. 1. This guide arm and guide roller arrangement assures an excellent guidance of the wire to the coil support so that thin wires may be readily coiled on supports of polygonal cross section without any difficulty. The fixing of the guide arm in a position aligned with the wire accurately positions a leading wire end so that it may be threaded in the adjoining gripping element of the coil support without the wire guide means immediately adjacent the coil support interfering with the coiling operation since the guide arm may be freely pivoted out of the aligned position.

As can be seen in FIG. 5, wire storage device 55 is constituted by spool 85 suspended from machine table 86 on a pivotal arm linked to the table. Device 87 is connected to the freely pivotal support arm of spool 85 and is arranged to emit a signal indicating the weight of spool 85 on which wire 53 is reeled for storage. The weight-indicating signal emitted by device 87 is used to control the braking force on spool 85 in response to this signal so as to avoid excessive tension on wire 53 when it is unreeled from spool 85. To assure uniform feeding of wire 53 to support 54 during the coiling operation, spool 85 is turned in the direction of arrow 89 by motor 88, for example a synchronous AC-motor. Motor 88 is controlled by wire loop control 90, wire tension sensor 91 emitting a control signal in response to the sensed tension of wire 53 for actuating or de-activating motor 88. When coil support 54 is turned to produce the wire coil, wire 53 is fed to the support and the wire is tensioned between storage device 55 and wire aligning device 56, causing wire tension sensor 91 to be pivoted against the bias of a coil spring attached thereto. The resultant signal is transmitted to control 90 to actuate motor 88 and turn spool 85 for feeding wire. When the coiling operation has stopped, clamping of the wire in wire guiding and feeding device 48, on the one hand, and further unreeling of the wire from turning spool 85, on the other hand, will cause a slack in wire 53 between the spool and the wire aligning device. The coil spring attached to sensor 91 will pivot the same in the direction of the slack wire and the resultant control signal transmitted by the sensor to control 90 will cause motor 88 to be de-activated so that no further wire is unreeled.

Figure 6:
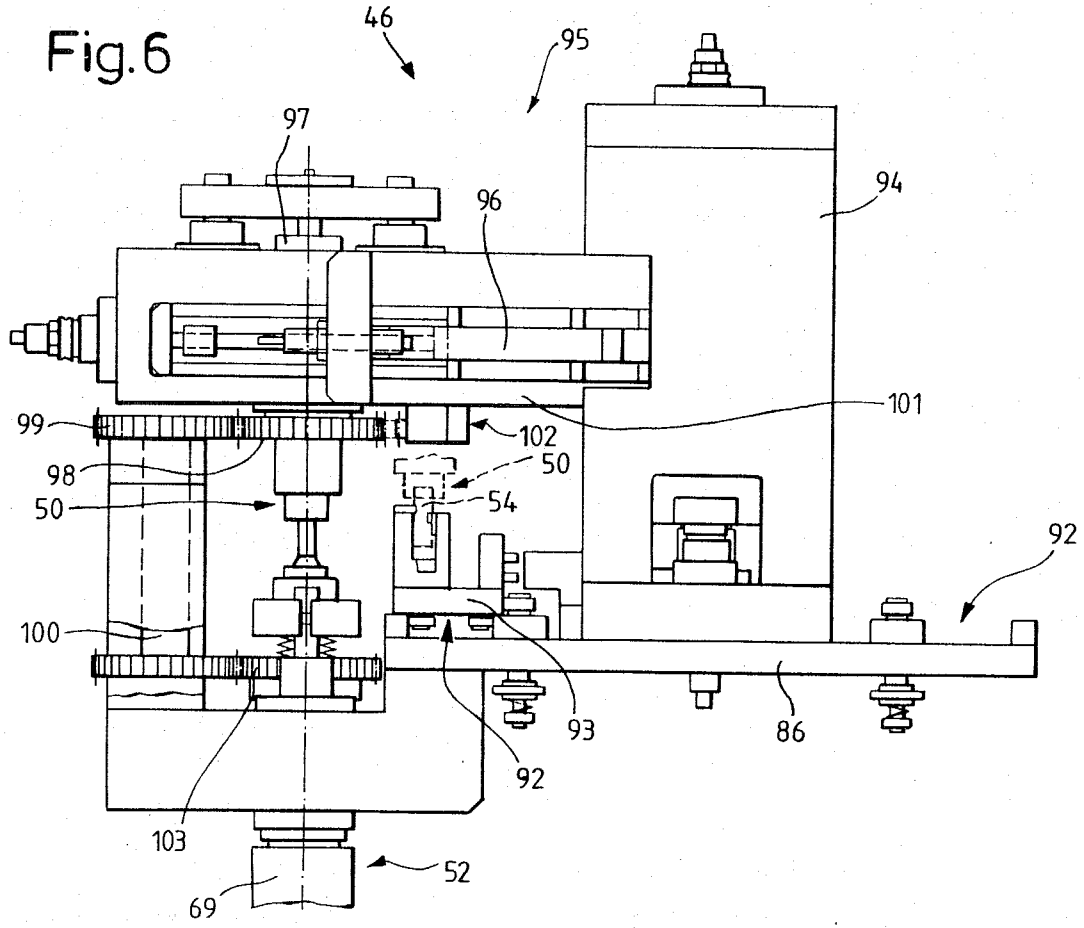
FIG. 6 is an end view of the wire coiler of FIG. 5, partly in section along line VI—VI of FIG. 5.

FIG. 6 shows machine table 86 supporting two conveyors 92 for carriers 93 capable of holding coil supports 54. The conveyors transport carriers 93 from one work station to another. Support 94 for operating mechanism 95 is positioned on machine table 86 in the range of wire coiler 46. Gripping element 50 holding coil support 54 may be moved between the coiling position shown in full lines and the conveying position shown in broken lines by operation of vertical drive 97 and transverse drive 96. Gear 98, which is coupled to gripping element 50 for rotation therewith, is not in mesh with gear 99 of intermediate drive shaft 100 when the gripping element with its coil support is moved. To enable gripping element 50 to be properly positioned when it is moved, carrier body 101 of operating mechanism 95 mounts fixing device 102 which comprises an abutment movable in the direction of gear 98 and capable of meshing therewith, the abutment engaging the gear between two teeth thereof for fixing the gear and gripping element coiled thereto in position. In this manner, when gripping element 50 is returned to the coiling position, proper meshing of gears 98 and 99 is assured. As has been fully explained in connection with the embodiment of FIG. 1, intermediate drive shaft 100 carries another gear meshing with gear 103 of other gripping element 49 so that, upon actuation of servo-motor 69, the entire gripping device holding support 50 clamped between its gripping elements will rotate.

The circuit diagram of FIG. 9 shows control 106 for a wire coiler of the above-described structures. This control comprises electric current source 107, indicating and operating panel 108, operating control 109 for sequencing the steps of the coiling operation, drive control 110 for operating the rotating drive 3 or 52 of the coil support and the adjustment drive 38 or 62 for the wire guiding and feeding device, servo-controls 112 and 113 connecting control 110 to the respective drives, and program carrier 111. Sequencing control 109 is connected by distributor 114 to the various drives, such as gripping element adjustment drives 16 or 97 and 17 or 96 as well as clamping drive 32 and adjustment drive 38 or 62. Suitable control and monitoring elements are connected to distributor 114 to indicate the respective end positions when the drives are operated and which transmit corresponding control signals to sequence the operating steps in their proper order.

Rotating drive 3 or 52 and adjustment drive 38 or 62 are constituted by DC-servo-motors or hydraulic servo-drives. As has been shown in FIG. 5, drives 52 and 62 are coupled directly to tacho-generator 115 and rotary angle determining element 116. The uniformity of the rotary movement is assured by transmitting the control signals via tacho-generator 115 from the drives to servo-controls 112 and 113. The incremental rotary angle determining element will then transmit a signal responsive to the angular rotary position of the drive to control 110 where this position is compared with the desired position predetermined by program 111. If the actual position of the respective drive corresponds to the programmed position, the drive is stopped. To obtain an exact initial position at the beginning of the coiling operation, a suitable reference signal emitter 117, such as electromagnetic proximity switch, is associated with drive 68 and a suitable reference signal emitter 118, such as a mechanically operable switch, is associated with drive 52 (see FIG. 5). Before the coiling operation is started, drives 52 and 68 are actuated to position them in a starting position determined by their associated reference signal emitters so that the program will always start from the same basis.

While sequencing control 109 operates all auxiliary functions of the wire coiler, control 110 exclusively controls the coiling operation itself, i.e. the turning of the coil support and the vertical movement of the wire in relation to the coil support. Providing the two separate controls enables external program 11 to be readily exchanged for the operation of different coiling programs while the basic control system is retained.

With the wire coiler operated in the manner hereinabove described, no counter-support is needed for positioning the coil windings on the support and the wire may be clamped together with the support by one of the gripping elements. The coil support may be clamped in position by the gripping element together with the leading wire end and it will not be deformed during the coiling operation by undue tension exerted upon the coiled wire. The sequential disengagement of the clamping jaws and the free pivoting of the guide arm at the time when the first steep winding of the coil is produced on the support assure that any desired coil pitch may be obtained for the subsequent windings since the guide arm directing the wire to the support pivots freely. We have found that one preferred mode to realize the control unit described in detail in FIG. 9 can be obtained in the following manner:

| | |
|---|---|
| Control 109 | Programmable Controller PC<br>Type: Klockner Moeller<br>SUCOS PS 24 |
| Drive control 110 | Computerized Numerical<br>Control CNC<br>Type: Philips CNC 3352<br>(Path control for 2 axes) |
| Servo control 112, 113 | Servo amplifier<br>1 axle 2 pulse Thyristor<br>variable gain amplifier<br>Type: Indramat: 1 TRM 2 |
| Rotating Drive 3, 52 | Direct current servo motor<br>Type: Indramat MDC 3.10 C |
| Drive 38, 62 | Direct current servo motor<br>Type: Indramat MDC 10.10 H |
| Tacho-generator 115 | Direct current tacho<br>alternator<br>Type: Indramat (included in<br>servo motor 3, 38) |
| Rotary angle determining<br>element 116 | Incremental rotating field<br>instrument<br>Type: Heidenhain ROD 420<br>(1000 increments per<br>rotation). |

While the control of FIG. 9 is quite conventional, we have found that best results can be obtained if the following program for the control 109 is used.

MASTER PROGRAM

Start of program/Master Program
Subroutine: PC
Pick up coil support 20 from workpiece carrier
and place it in wire coiler 1
Subroutine: CNC
Position driving spindle with gripping element 4
in wire 25 feeding position
Subroutine: PC
Feed wire 25
Subroutine: CNC
Wind wire 25 on coil support 20
Subroutine: PC
Cutting wire 25
Subroutine: CNC
Position driving spindle and gripping element 5
in pick up position
Subroutine: PC
Pick up coil support 20 from wire coiler and
place it in workpiece carrier
End of program/Master Program

SUBROUTINE 1

Start of program/Subroutine UP 1
Gripping device 6:
Vertical adjustment drive 16 down (above work
piece carrier)
Gripping device 6:
Close gripping element 5
Gripping device 6:
Vertical adjustment drive 16 up
Gripping device 6:
Horizontal adjustment drive 17 above gripping
element 4 (in working position)
Gripping device 6:
Vertical adjustment drive 16 down
Gripping-element 4:
close gripping jaws 7, 8
Dislock spur gear fixing device 102
End of program/Subroutine 1

SUBROUTINE 3

Start of program/Subroutine UP 3
Gripping element 4:
Open gripping jaws 7, 8
Extend drive 60
Extend piston 76 of lining jaw 73
Gripping element 4:
Close gripping jaws 7, 8
Retract piston 76
Disengage fixing device 81 for pivotal guide arm 79
Disengage clamping drive 32
Retract drive 60
End of program/Subroutine 3

SUBROUTINE 5

Start of program/Subroutine UP 5
Clamping drive 32:
clamp wire 25
Cutting device 57:
extend cylinder
Cutting device 57:
retract cylinder
Engage fixing device 81
drive 84 for pivotal guide arm 79
End of program/Subroutine 5

SUBROUTINE 7

Start of program/Subroutine UP 7
Lock spur gear fixing device 102
Gripping element 4:
Open gripping jaws 7, 8

-continued

| |
|---|
| Gripping device 6: |
| Vertical adjustment drive 16 up |
| Gripping device 6: |
| Horizontal adjustment drive 17 above work piece carrier |
| Gripping element 6: |
| Vertical adjustment drive 17 down |
| Gripping element 6: |
| Open gripping jaws 7, 8 |
| Gripping element 6: |
| Vertical adjustment drive 17 up |
| End of program/Subroutine 7 |

What we claim is:

1. A wire coiler comprising
(a) an elongated coil support,
(b) a gripping device holding the coil support for rotation therewith, the gripping device comprising
(1) two gripping elements spaced from each other in the direction of elongation of the coil support,
(c) a drive connected to the gripping device and common to the two gripping elements for rotating the gripping device, the drive having an axis extending parallel to the direction of elongation of the coil support,
(d) a control for the drive,
(e) a device for guiding and feeding the wire to the coil support,
(f) an adjustment drive connected and responsive to the rotating drive control, the adjustment drive cooperating with the wire guiding and feeding device for adjustably positioning the same in directions parallel to the direction of elongation of the coil support and relative thereto, and
(g) another adjustment drive for adjustably positioning one of the gripping elements in relation to the other gripping element transversely said direction.

2. The wire coiler of claim 1, further comprising an adjustment drive for adjustably positioning one of the gripping elements in relation to the other gripping element in said direction.

3. The wire coiler of claim 1, further comprising means for slidingly moving the coil support in relation to one of the gripping elements.

4. The wire coiler of claim 3, further comprising a machine table supporting the wire coiler, the one gripping element being mounted on the machine table.

5. The wire coiler of claim 4, wherein the rotating drive is connected to the one gripping element for rotation therewith, and further comprising a respective gear associated with each gripping element, an intermediate drive shaft having respective gears meshing with the gears of the gripping elements in a coiling position of the gripping device, the meshing gears of the one gripping element and of the intermediate drive shaft causing the rotating drive to rotate the intermediate shaft, a support for the other gripping element, and a fixing device for the gear associated with the other gripping element mounted on the support for the other gripping element.

6. The wire coiler of claim 3, wherein the one gripping element is arranged for gripping the coil support and one end of the wire coiled thereon.

7. A wire coiler comprising
(a) an elongated coil support,
(b) a gripping device holding the coil support for rotation therewith, the gripping device comprising
(1) two gripping elements spaced from each other in the direction of elongation of the coil support,
(c) a drive connected to the gripping device and common to the two gripping elements for rotating the gripping device, the drive having an axis extending parallel to the direction of elongation of the coil support,
(d) a control for the drive,
(e) a device for guiding and feeding the wire to the coil support, the wire guiding and feeding device having
(1) two relatively adjustable guide jaws,
(2) a clamping drive for adjusting the guide jaws relative to each other and for clamping the guide jaws in their adjusted position,
(3) a guide arm associated with one of the gripping elements, the guide arm being pivotal about an axis extending parallel to the coil support, and
(4) a wire guide roller arranged between the guide jaws and the wire guide arm, and
(f) an adjustment drive connected and responsive to the rotating drive control, the adjustment drive cooperating with the wire guiding and feeding device for adjustably positioning the same in directions parallel to the direction of elongation of the coil support and relative thereto.

8. The wire coiler of claim 1 or 7, further comprising a storage device for the wire, the storage device being arranged to unreel the stored wire and to feed the unreeled wire to the wire guiding and feeding device.

9. The wire coiler of claim 8, further comprising an automatic braking device for the wire storage device, the drive control being connected to the braking device for actuating the braking device in response to the weight of the wire storage device.

10. The wire coiler of claim 9, wherein the wire storage device comprises a horizontally extending wire support plate, and further comprising a rotatable axle supporting the support plate and a friction coupling between the axle and the support plate constituting the braking device.

11. The wire coiler of claim 8, further comprising a wire aligning device arranged between the wire storage device and the wire guiding and feeding device.

12. The wire coiler of claim 11, wherein the wire aligning device comprises a succession of rectilinearly arrayed aligning stations, each aligning station comprising a pair of relatively adjustable lining jaws receiving the wire therebetween and a drive for adjusting the lining jaws relative to each other.

13. The wire coiler of claim 11, further comprising a wire cutting device arranged between the wire guiding and feeding device and the gripping device for determining the length of the coiled wire.

14. The wire coiler of claim 1 or 7, further comprising a carrier slide supporting the wire guiding and feeding device, a guide track adjustably supporting the carrier slide, the guide track extending in the direction of the wire being guided and fed by the device, and a drive connected to the carrier slide for advancing the carrier slide along the guide track.

15. The wire coiler of claim 14, further comprising a wire aligning device supported on the carrier slide and arranged between the wire storage device and the wire guiding and feeding device.

16. The wire coiler of claim 15, further comprising a wire cutting device supported on the carrier slide and arranged between the wire guiding and feeding device and the gripping device for determining the length of the coiled wire.

17. The wire coiler of claim 1 or 7, further comprising a machine table supporting the wire coiler, one of the gripping elements being mounted on the machine table, the one gripping element including a gripping jaw defining a recess and arranged on a side of the coil support opposite the coil support side receiving the wire from the guiding and feeding device, the recess facing the wire guiding and feeding device in an initial position at the beginning of a coiling operation.

18. A method of coiling a wire on a wire coiler comprising an elongated coil support, a gripping device holding the coil support for rotation therewith, the gripping device comprising two gripping elements spaced from each other in the direction of elongation of the coil support and one of the gripping elements having two cooperating gripping jaws, the one gripping element comprising a sliding element for positioning the coil support in relation to one of the gripping jaws, a drive common to the two gripping elements and connected to the gripping device for rotating the gripping device, the drive having an axis extending parallel to the direction of elongation of the coil support, a control for the drive, a device for guiding and feeding the wire to the coil support, the wire guiding and feeding device having two relatively adjustable guide jaws, a clamping drive for adjusting the guide jaws relative to each other and for clamping the guide jaws in their adjusted position, and a guide arm associated with one of the gripping elements, the guide arm being pivotal about an axis extending parallel to the coil support, a carrier slide supporting the wire guiding and feeding device, a guide track adjustably supporting the carrier slide, the guide track extending in the direction of the wire being guided and fed by the device, a drive connected to the carrier slide for advancing the carrier slide along the guide track, and an adjustment drive connected and responsive to the rotating drive control, the adjustment drive cooperating with the wire guiding and feeding device for adjustably positioning the same in directions parallel to the direction of elongation of the coil support and relative thereto, which method comprises the steps of operating the clamping drive for clamping the wire between the clamping jaws of the wire guiding and feeding device while fixing the pivotal guide arm in a rest position, subsequently operating the drive for advancing the carrier slide along the guide track in the direction of the one gripping element while operating the drive for positioning the coil support into engagement with one of the gripping jaws of the one gripping element, engaging the gripping jaws with each other after the wire has been fed to the one gripping element, and then operating the adjustment drive for moving the wire guiding and feeding device in the direction of elongation of the coil support from the one gripping element towards the other gripping element.

19. The wire coiling method of claim 18, comprising the further steps of operating the clamping drive to disengage the clamping jaws and permitting the pivotal guide arm to pivot and subsequently operating the rotating drive to rotate the gripping device.

20. The wire coiling method of claim 19, wherein the adjustment drive is operated to move the wire guiding and feeding device stepwise in the direction of the other gripping element.

* * * * *